US006443810B1

(12) United States Patent
Shih

(10) Patent No.: US 6,443,810 B1
(45) Date of Patent: Sep. 3, 2002

(54) POLISHING PLATEN EQUIPPED WITH GUARD RING FOR CHEMICAL MECHANICAL POLISHING

(75) Inventor: Tsu Shih, Hsin-Chu (TW)

(73) Assignee: Taiwan Semiconductor Manufacturing Co., Ltd., Hsin Chu (TW)

( * ) Notice: Subject to any disclaimer, the term of this patent is extended or adjusted under 35 U.S.C. 154(b) by 0 days.

(21) Appl. No.: 09/547,256

(22) Filed: Apr. 11, 2000

(51) Int. Cl.[7] ..... B24B 1/00

(52) U.S. Cl. ..... 451/41; 451/60; 451/285; 451/287; 451/446

(58) Field of Search ..... 451/285–289, 451/446–447, 453, 60

(56) References Cited

U.S. PATENT DOCUMENTS 5,299,393 A * 4/1994 Chandler et al. ..... 451/60
5,384,986 A * 1/1995 Hirose et al. ..... 451/444
5,702,291 A * 12/1997 Isobe ..... 451/41
5,879,222 A * 3/1999 Robinson ..... 451/41
5,938,507 A * 8/1999 Ko et al. ..... 451/56
6,024,630 A * 2/2000 Shendon et al. ..... 451/41

FOREIGN PATENT DOCUMENTS

JP 363114861 * 5/1988 ..... 451/446

* cited by examiner

*Primary Examiner*—George Nguyen
(74) *Attorney, Agent, or Firm*—Tung & Associates

(57) ABSTRACT

A polishing pad platen that is equipped with a guard ring, or a slurry retaining collar, used in chemical mechanical polishing (CMP) for conserving usage of polishing slurry is described. A method for conserving slurry solution during a CMP process is further described. In the novel polishing pad platen, a guard ring is mounted to the platen by sealiningly engaging an outer periphery of the platen for preventing spilling out of slurry solution during a polishing operation. The guard ring is mounted to slidingly engage the platen in such a way that the ring may be lowered to be completely out of the way during a pad condition process in which the spinning out of a pad conditioning solution from a top surface of the polishing pad is necessary.

12 Claims, 3 Drawing Sheets

POLISHING PLATEN EQUIPPED WITH GUARD RING FOR CHEMICAL MECHANICAL POLISHING

FIELD OF THE INVENTION

The present invention generally relates to a polishing platen for holding a polishing pad thereon in a polishing apparatus and a method for using the platen and more particularly, relates to a polishing platen that is equipped with a guard ring for a chemical mechanical polishing apparatus and a method for conserving slurry usage during a chemical mechanical polishing process by using a guard ring.

BACKGROUND OF THE INVENTION

Apparatus for polishing thin, flat semiconductor wafers is well-known in the art. Such apparatus normally includes a polishing head which carries a membrane for engaging and forcing a semiconductor wafer against a wetted polishing surface, such as a polishing pad. Either the pad, or the polishing head rotates and oscillates the wafer over the polishing surface. The polishing head is forced downwardly onto the polishing surface by a pressurized air system or by a similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a wafer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the wafer and/or polishing head; a wafer unload station; or, a wafer load station.

More recently, chemical-mechanical polishing (CMP) apparatus has been employed in combination with a pneumatically actuated polishing head. CMP apparatus is used primarily for polishing the front face or device side of a semiconductor wafer during the fabrication of semiconductor devices on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in de-ionized water.

A schematic of a typical CMP apparatus is shown in FIGS. 1A and 1B. The apparatus 10 for chemical mechanical polishing consists of a rotating wafer holder 14 that holds the wafer 10, the appropriate slurry 24, and a polishing pad 12 which is normally mounted to a rotating table 26 by adhesive means. The polishing pad 12 is applied to the wafer surface 22 at a specific pressure. The chemical mechanical polishing method can be used to provide a planar surface on dielectric layers, on deep and shallow trenches that are filled with polysilicon or oxide, and on various metal films. CMP polishing results from a combination of chemical and mechanical effects. A possible mechanism for the CMP process involves the formation of a chemically altered layer at the surface of the material being polished. The layer is mechanically removed from the underlying bulk material. An altered layer is then regrown on the surface while the process is repeated again. For instance, in metal polishing a metal oxide may be formed and removed repeatedly.

A polishing pad is typically constructed in two layers overlying a platen with the resilient layer as the outer layer of the pad. The layers are typically made of polyurethane and may include a filler for controlling the dimensional stability of the layers. The polishing pad is usually several times the diameter of a wafer and the wafer is kept off-center on the pad to prevent polishing a non-planar surface onto the wafer. The wafer is also rotated to prevent polishing a taper into the wafer. Although the axis of rotation of the wafer and the axis of rotation of the pad are not collinear, the axes must be parallel. It is known in the art that uniformity in wafer polishing is a function of pressure, velocity and the concentration of chemicals. Edge exclusion is caused, in part, by non-uniform pressure on a wafer. The problem is reduced somewhat through the use of a retaining ring which engages the polishing pad.

Referring now to FIG. 1C, wherein an improved CMP head, sometimes referred to as a Titan® head which differs from conventional CMP heads in two major respects is shown. First, the Titan® head employs a compliant wafer carrier and second, it utilizes a mechanical linkage (not shown) to constrain tilting of the head, thereby maintaining planarity relative to a polishing pad 12, which in turn allows the head to achieve more uniform flatness of the wafer during polishing. The wafer 10 has one entire face thereof engaged by a flexible membrane 16, which biases the opposite face of the wafer 10 into face-to-face engagement with the polishing pad 12. The polishing head and/or pad 12 are moved relative to each other, in a motion to effect polishing of the wafer 10. The polishing head includes an outer retaining ring 14 surrounding the membrane 16, which also engages the polishing pad 12 and functions to hold the head in a steady, desired position during the polishing process. As shown in FIG. 1C, both the retaining ring 14 and the membrane 16 are urged downwardly toward the polishing pad 12 by a linear force indicated by the numeral 18 which is effected through a pneumatic system.

In the polishing operation shown in FIG. 1B, the slurry solution 24 must be pushed into an interface between the wafer 10 and the polishing pad 12 in order for the chemical reaction and the mechanical removal process to operate efficiently. Since the surface of a silicon wafer is a hard surface and the surface of the polishing pad is normally formed of densely packed fibers, it is difficult to ensure an abundant supply of the slurry solution at the interface between the wafer and the polishing pad. Various techniques have been proposed to improve the supply of the slurry solution into the interface and to conserve the usage of slurry solution. Two of such techniques are shown in FIGS. 2A, 2B, 3A and 3B. FIGS. 2A and 2B show a technique in which a perforated polishing pad 28 is utilized. The perforated polishing pad 28 is formed with a multiplicity of perforations 30 through the pad thickness. As shown in FIG. 2B, typically, a perforation having a diameter of 0.075 in. and a height of 0.05 in. (i.e. through the complete thickness of the hard pad 32) is used. Alternatively, a more popularly used technique is to provide a grooved polishing pad 34 as shown in FIG. 3A. In the grooved polishing pad 34, grooves 36 are provided in a surface layer 38 of the hard pad. As shown in FIG. 3B, a typical groove is formed with a width of 0.01 in. and a depth of 0.015 in., while the groove-to-groove distance is about 0.06 in. It should be noted that the perforations 30 and the grooves 36 are formed only through or in the hard pad layer and not into the soft pad layer.

While the perforated pad or the grooved pad shown in FIGS. 2A~3B provides some improvement over conventional polishing pads that have no surface modifications, the improvement is limited in the uniformity of the surface polishing and in the slurry consumption.

Another method for improving the polishing efficiency and conserving slurry consumption has been disclosed in a co-pending application Ser. No. 09/366,233 filed Aug. 3, 1999 and assigned to the common assignee of the present application, which is incorporated herein by reference in its entirety. In application Ser. No. 09/366,233, shown in FIGS. 4A and 4B, therein is provided a slotted retaining ring 40 adapted for holding a CMP polishing head. The retaining ring 40 includes a torroidal ring member 44 that has parallely situated planer top surface 48 and bottom surface 46. The torroidal ring member 44 further includes an inner periphery 50 defined by an inner diameter and an outer periphery 52 defined by an outer diameter. The inner diameter is sufficiently large for holding a polishing pad (not shown) therein. In the bottom surface 46 (which is shown in FIG. 43 facing up), a plurality of slot recesses 42 are formed. Each of the plurality of slot recesses may be formed in a tapered shape with a base portion 54 adjacent to the outer periphery 52 and a tip portion 56 of smaller width than the base portion adjacent to the inner periphery 50. The tip portion 56 of the slot recesses 42 is spaced apart from the inner periphery 50 by a distance "D" such that the slot recess does not open through the inner periphery 50.

The slotted retaining ring 40 shown in FIGS. 4A and 4B, while effective to some extent in feeding slurry solution spun out to the outer periphery of the wafer back into the center of the wafer, and therefore improving polishing uniformity and reducing slurry consumption. However, the slotted retaining ring does not conserve a significant amount of slurry solution wasted, i.e. the amount being spun off the polishing pad. As a result, during a chemical mechanical polishing process, at least two or three times the slurry solution that is actually needed for polishing is consumed. Once spun off the polishing pad, a slurry solution is contaminated and can no longer be collected and reused.

It is therefore an object of the present invention to provide a polishing platen for use in a chemical mechanical polishing apparatus that does not have the drawbacks or shortcomings of the conventional polishing platens.

It is another object of the present invention to provide a polishing platen for use in a chemical mechanical polishing apparatus that is equipped with a guard ring mounted onto the platen for preventing slurry solution from spun off the polishing pad.

It is a further object of the present invention to provide a polishing platen for use in a chemical mechanical polishing apparatus for conserving slurry solution usage during the CMP process.

It is another further object of the present invention to provide a polishing platen for use in a chemical mechanical polishing apparatus that is equipped with a guard ring mounted to the outer periphery of the platen allowing the guard ring to be moved upwardly and downwardly.

It is still another object of the present invention to provide a polishing platen used in a chemical mechanical polishing apparatus equipped with a guard ring for preventing spinning off of the slurry solution when the ring is moved to an upper position.

It is yet another object of the present invention to provide a polishing platen for use in a chemical mechanical polishing apparatus that is equipped with a guard ring which allows a conditioning solution to be spun off a polishing pad during a pad conditioning process when the guard ring is moved to in a lower position.

It is still another further object of the present invention to provide a method for conserving slurry solution during a chemical mechanical polishing process by raising a guard ring mounted on an outer periphery of the polishing platen to sealingly engage a top surface of the polishing pad during the CMP process.

It is yet another further object of the present invention to provide a method for conserving slurry solution during a chemical mechanical polishing process by lowering a guard ring mounted on a polishing platen to allow a conditioning solution to be spun off a polishing pad during a pad conditioning process.

SUMMARY OF THE INVENTION

In accordance with the present invention, a polishing platen that is equipped with a guard ring for use in chemical mechanical polishing for conserving usage of polishing slurry and a method for conserving slurry solution during a chemical mechanical polishing process are provided.

In a preferred embodiment, a polishing platen that is equipped with a guard ring for use in a chemical mechanical polishing for conserving usage of slurry solution is provided which includes a rotatable platen of circular shape supported by a shaft, a polishing pad mounted on the rotatable platen, and a guard ring sealingly engaging an outer periphery of the rotatable platen for preventing spilling out of slurry solution during a polishing operation.

In the polishing platen that is equipped with a guard ring for conserving usage of polishing slurry in a chemical mechanical polishing process, the guard ring may have a pre-set height of at least 1 cm. The polishing platen may further include means for slidingly engaging the guard ring with the outer periphery of the platen, or means for slidingly engaging and moving up-and-down the guard ring on the outer periphery of the platen, or electrical means for slidingly engaging and moving up-and-down the guard ring on the outer periphery of the platen. The guard ring may rotate with the rotatable platen during a polishing operation. The guard ring may be moved upwardly to sealingly engage a top surface of the polishing pad for preventing spilling out of slurry solution during a polishing operation, or the guard ring may be moved downwardly to disengage from the top surface of the polishing pad for allowing spinning out of a conditioning solution during a pad conditioning process.

The present invention is further directed to a polishing pad platen for use in a slurry polishing process which includes a rotatable platen for rotating on a motor driven shaft, a polishing pad mounted on the rotatable platen, and a slurry retaining collar sealingly engaging a periphery of the polishing pad for preventing spilling out of slurry solution during a polishing process.

In the polishing pad platen for use in a slurry polishing process, the rotatable platen and the motor driven shaft are contained in an enclosure. The slurry retaining collar may be movable in an up-and-down motion on the polishing pad platen by a mechanical means, or by an electrical means. The slurry retaining collar may be moved to an upper position for sealingly engaging a top surface of the polishing pad for preventing spilling out of slurry solution during a polishing operation, or may be moved to a lower position for disengaging from the top surface of the polishing pad for allowing spilling out of a pad conditioning solution during a polishing pad conditioning process.

The present invention is further directed to a method for conserving slurry solution during a chemical mechanical polishing (CMP) process that can be carried out by the steps of providing a rotatable platen supported on a motor driven shaft, mounting a polishing pad on the rotatable platen, mounting a guard ring on an outer periphery of the rotatable platen to seemingly engaging a top surface of the polishing pad, and conducting a CMP process on an electronic substrate and preventing spilling out of a slurry solution from the top surface of the polishing pad.

The method for conserving slurry solution during a CMP process may further include the step of mounting the guard ring on the outer periphery of the rotatable platen in a sliding engagement allowing upward and downward movement of the guard ring for sealingly engaging and disengaging a top surface of the polishing pad, respectively. The method may further include the step of making the upward and downward movements mechanically, or electrically. The method may further include the step of moving the guard ring downwardly on the periphery of the rotatable platen to disengage the guard ring from a top surface of the polishing pad during a pad conditioning process, or the step of sealingly engaging the guard ring to the top surface of the polishing pad in such a way that the guard ring protrudes from the top surface of the polishing pad by a distance of at least 1 cm, and preferably by a distance of at least 2.5 cm.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

The present invention discloses a polishing pad platen that is equipped with a guard ring (or slurry retaining collar) used in chemical mechanical polishing for conserving usage of the slurry solution. The present invention is further directed to a method for conserving slurry solution during a CMP process.

In the present invention polishing pad platen, a guard ring sealingly engages an outer periphery of the platen for preventing spinning out (or spilling out) of slurry solution during a pad polishing operation. The guard ring has a predetermined height of at least 1 cm, and preferably a predetermined height of at least 2.5 cm. The guard ring slidingly engages the outer periphery of the polishing pad platen for moving up-and-down. When the guard ring is moved up into an upper position, the guard ring blocks any spilling out of a slurry solution when the polishing platen rotates at a high rotational speed. After a polishing process is completed on an electronic substrate, the guard ring can be moved downwardly into a lower position such that a pad conditioning solution spins off the top surface of the polishing pad during a pad conditioning process. The present invention novel apparatus prevents spilling of a polishing slurry solution while allowing the spilling out of a pad conditioning solution.

In the method for conserving slurry solution during a CMP process, the method can be carried out by mounting a guard ring (or slurry retaining collar) on the outer periphery of a rotatable polishing pad platen to sealingly engage a top surface of the polishing pad during a CMP process so that the spilling out of slurry solution from the top surface of the polishing pad can be prevented. The present invention novel method saves the usage of a polishing slurry solution by as much as 70%. The up-and-down motion of the guard ring on the polishing pad platen can be effected by either a mechanical means, or by an electrical means. The method can further be carried out by moving the guard ring downwardly on the periphery of the rotatable polishing pad platen to disengage the guard ring from a top surface of the polishing pad during a pad conditioning process.

Figure 1A:
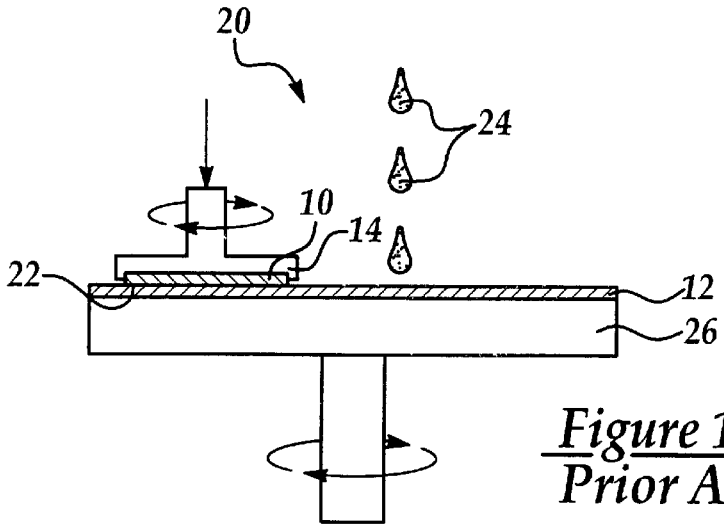
Figure 1A Prior Art
FIG. 1A is a cross-sectional view of a conventional CMP apparatus.
Figure 1B:
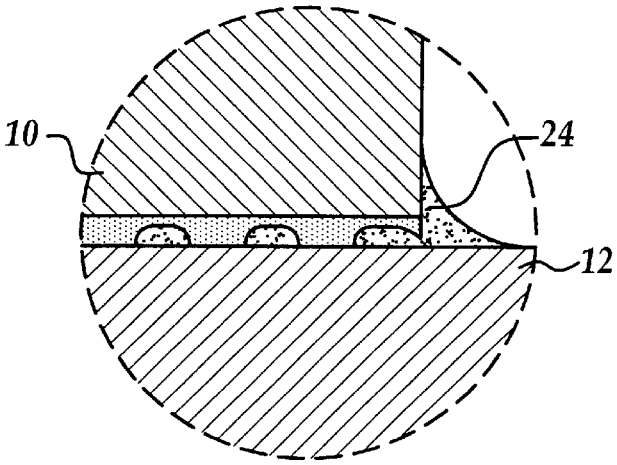
Figure 1B Prior Art
FIG. 1B is a partial, enlarged cross-sectional view taken from FIG. 1A illustrating an interaction of slurry solution between the wafer and the polishing pad.
Figure 1C:
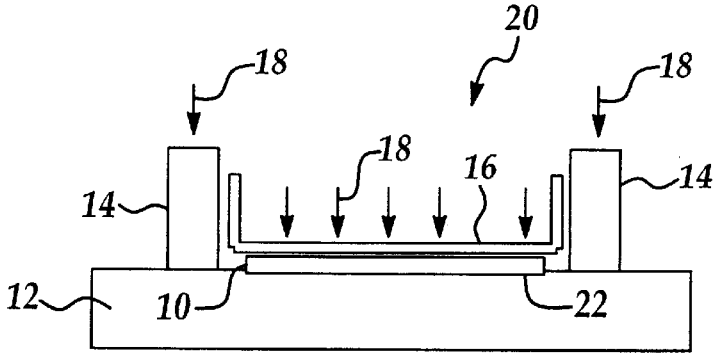
Figure 1C Prior Art
FIG. 1C is a cross-sectional view of an improved polishing pad utilizing a membrane pressurizing device.
Figure 2A:
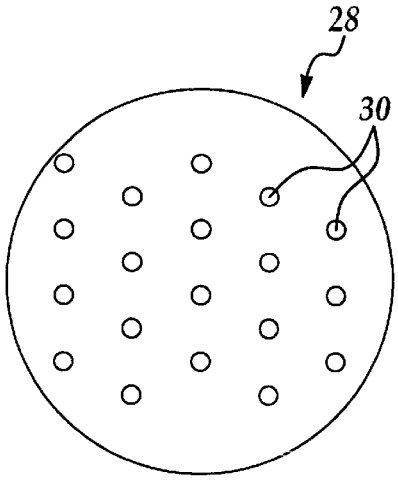
Figure 2A Prior Art
FIG. 2A is a plane view of a conventional polishing pad with perforations.
Figure 2B:
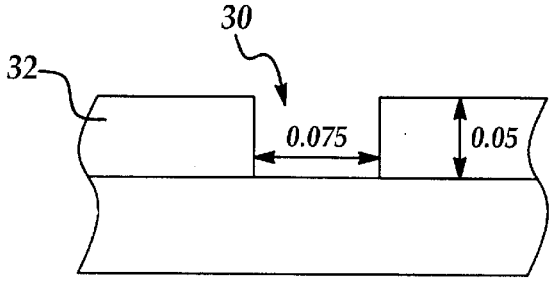
Figure 2B Prior Art
FIG. 2B is a partial, enlarged cross-sectional view of a perforation shown in FIG. 2A.
Figure 3A:
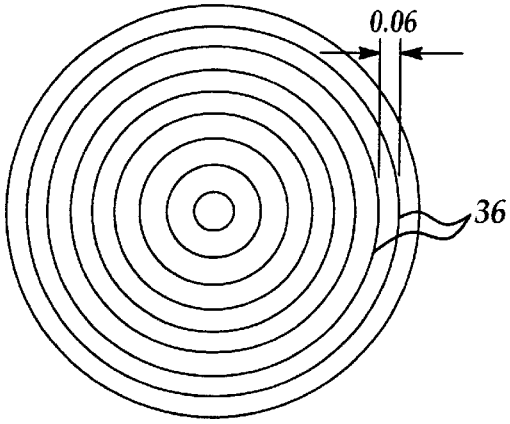
Figure 3A Prior Art
FIG. 3A is a plane view of a conventional polishing pad equipped with grooves in the pad surface.
Figure 3B:
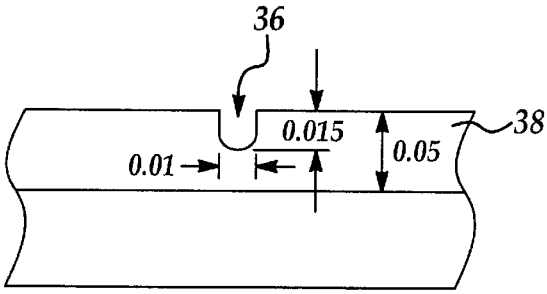
Figure 3B Prior Art
FIG. 3B is a partial, enlarged cross-sectional view of the grooved polishing pad of FIG. 3A.
Figure 4A:
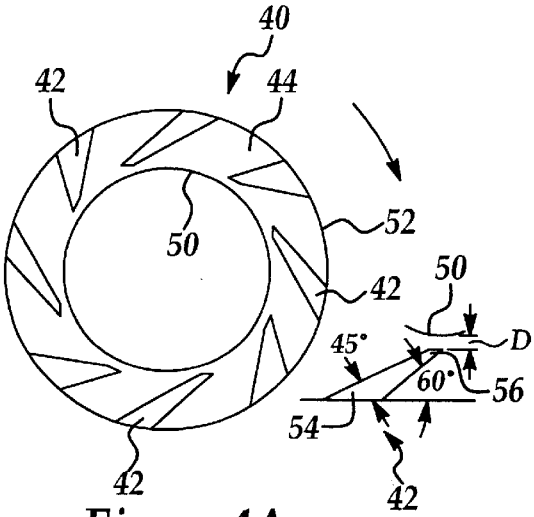
FIG. 4A is a plane view of a bottom side of a slotted retaining ring.
Figure 4B:
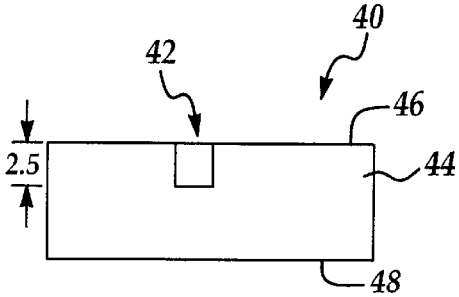
FIG. 4B is a cross-sectional view taken along section AA of FIG. 4A illustrating a slot recess.
Figure 5A:
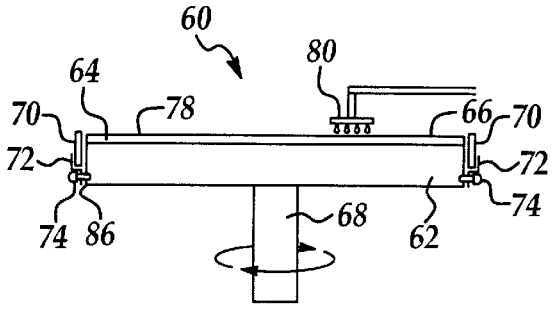
FIG. 5A is a cross-sectional view of the present invention polishing pad platen with the guard ring in a lower position.

Referring now to FIG. 5A, wherein a present invention polishing pad platen 60 is shown. The polishing pad platen 60 consists of a platen 62, a polishing pad 64 adhesively bonded to a top surface 66 of the platen 62. The platen 62 is supported on a shaft 68 which is in turn connected to a motor means (not shown) for providing rotational motion of the platen 62. A present invention guard ring 70 is attached to the platen 62 by a mechanical mounting means, i.e. by a bracket 72 and bolt 74. It should be noted that in the configuration shown in FIG. 5A, the guard ring 70 is mounted in a lower position allowing conditioning solution to be ejected, or spilled out from the top surface 78 of the polishing pad 64. Also shown in FIG. 5A, is a conditioning arm 80 for conditioning the top surface 78 of the pad 64.

Figure 5B:
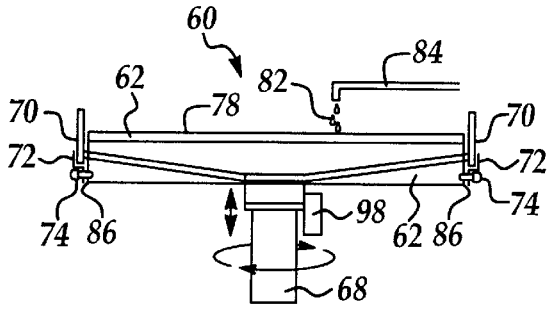
FIG. 5B is a cross-sectional view of the present invention polishing pad platen with the guard ring in an upper position.

Contrary to the configuration shown in FIG. 5A, FIG. 5B illustrates the present invention guard ring in an engaged position, i.e. to sealingly engaging the top surface 78 of the polishing pad 62 such that spilling out of the slurry solution 82 dispensed from a slurry tube 84 can be prevented. It should be noted that the same mounting bracket 72 and bolt 74 are utilized for mounting the guard ring 70 at an upper position by using upper mounting holes (not shown) provided on the periphery 86 of the platen 62.

Figure 5C:
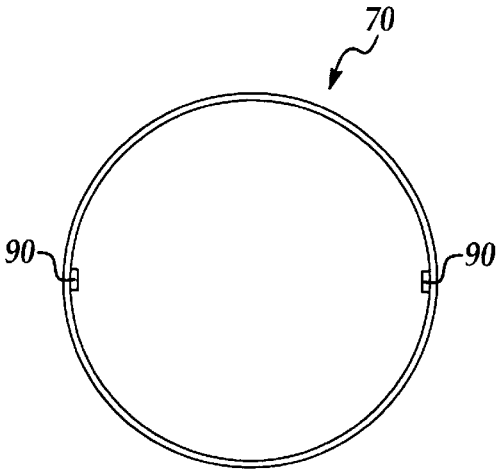
FIG. 5C is a plane view of the present invention guard ring equipped with keys for mounting.
Figure 5D:
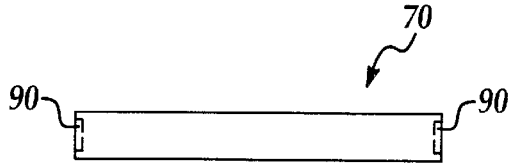
FIG. 5D is a side view of the present invention guard ring.
Figure 5E:
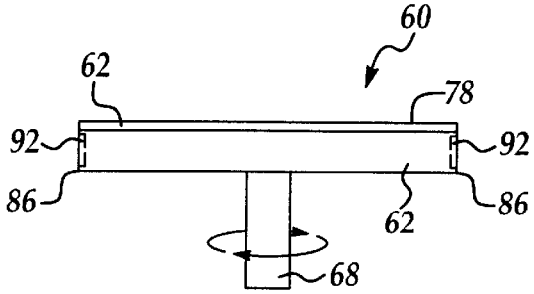
FIG. 5E is a cross-sectional view of the present invention polishing pad platen with mounting slots provided for mating with keys on the guard ring.

Detailed views of the guard ring 70 are shown in FIGS. 5C and 5D. FIG. 5C shows a plane view of the guard ring 70 indicating a suitable thickness of the ring is necessary to maintain its shape and rigidity. At least two keys 90 are provided on the inside periphery of the guard ring 70 for sliding engagement with the platen 62. The keys 90 are further shown in ghost lines in a side view of the guard ring 70 in FIG. 5D. Corresponding mounting slots 92 for engaging the keys 90 are provided in the periphery 86 of the platen 62, as shown in FIG. 5E. It should be noted that while two keys 90 are shown in FIGS. 5C and 5D, and corresponding slots 92 are shown in Figure SE, any suitable number of keys, preferably three or four that are equally spaced circumferentially at 120° or 90° interval may be used. The keys 90 fit snugly inside the slot 92 such that a vertical, up-and-down sliding engagement between the guard ring 70 and the platen 62 can be achieved.

It should also be noted that while mechanical means, i.e. brackets 72 and bolts 74 are utilized in fixing the position of the guard ring 70, other means such as an electrical means 98 (shown in FIG. 5B) utilizing a motor can be used to elevate or lower the guard ring 70 in an more automated manner.

The present invention novel polishing pad platen equipped with a guard ring for conserving usage of polishing slurry solution and a method for conserving slurry solution during a chemical mechanical polishing process have therefore been amply described in the above description and in the appended drawings of FIGS. 5A~5E.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows:

What is claimed is:

1. A polishing platen equipped with a guard ring used in chemical mechanical polishing for conserving usage of polishing slurry comprising:

a rotatable platen of circular shape supported by a shaft;

a polishing pad mounted on the rotatable platen;

a guard ring having a preset height of at least 1 cm sealingly engaging an outer periphery of said platen for preventing spilling out of slurry solution during a polishing operation; and electrical means for slidingly engaging and moving up-and-down said guard ring on said outer periphery of said platen, in such a way that when the guard ring is in a down position said guard ring is at the same level with the polishing pad.

2. A polishing platen equipped with a guard ring used in chemical mechanical polishing for conserving usage of polishing slurry according to claim 1, wherein said guard ring rotates with said rotatable platen during a polishing operation.

3. A polishing platen equipped with a guard ring used in chemical mechanical polishing for conserving usage of polishing slurry according to claim 1, wherein said guard ring being moved upwardly to sealingly engage a top surface of said polishing pad for preventing spilling out of slurry solution during a polishing operation.

4. A polishing platen equipped with a guard ring used in chemical mechanical polishing for conserving usage of polishing slurry according to claim 1, wherein said guard ring being moved downwardly to disengage from said top surface of said polishing pad for allowing spilling out of a pad conditioning solution during a polishing pad conditioning process.

5. A polishing pad platen for use in a slurry polishing process comprising:

a rotatable platen for rotating on a motor driven shaft;

a rotating pad mounted on said rotatable platen; and a slurry retaining collar slidingly engaging a periphery of said polishing pad for preventing spilling out of slurry solutions during a polishing process, said slurry retaining collar being movable in an up-and-down motion on said platen by an electrical means in such a way that when the guard ring is in a down position said guard ring is at the same level with the polishing pad.

6. A polishing pad platen for use in a slurry polishing process according to claim 5, wherein said rotatable platen and said motor driven shaft being contained in an enclosure.

7. A polishing pad platen for use in a slurry polishing process according to claim 5, wherein said slurry retaining collar being movable in an up-and-down motion on said polishing pad platen by a mechanical means.

8. A polishing pad platen for use in a slurry polishing process according to claim 5, wherein said slurry retaining collar being moved to an upper position for sealingly engaging a top surface of said polishing pad for preventing spilling out of slurry solution during a polishing operation.

9. A polishing pad platen for use in a slurry polishing process according to claim 5, wherein said slurry retaining collar being moved to a lower position for disengaging from said top surface of said polishing pad for allowing spilling out of a pad conditioning solution during a polishing pad conditioning process.

10. A method for conserving slurry solution during a chemical mechanical polishing (CMP) process comprising the steps of:

providing a rotatable platen supported on a motor driven shaft;

mounting a polishing pad on said rotatable platen;

mounting a guard ring on an outer periphery of said rotatable platen in a sliding engagement allowing upward and downward movement of said guard ring by electrical means for sealingly engaging a periphery of said polishing pad; and conducting a CMP process on an electronic substrate and preventing spilling out of a slurry solution from said top surface of the polishing pad.

11. A method for conserving slurry solution during a CMP process according to claim 10 further comprising the step of moving said guard ring downwardly on said periphery of said rotatable platen to disengage said guard ring from a top surface of said polishing pad during a pad conditioning process.

12. A method for conserving slurry solution during a CMP process according to claim 10 further comprising the step of moving said guard ring to said top surface of said polishing pad in such a way that the guard ring protrudes from said top surface of the polishing pad by a distance of at least 1 cm.

* * * * *